US007937786B2

(12) United States Patent
Bergkvist

(10) Patent No.: US 7,937,786 B2
(45) Date of Patent: May 10, 2011

(54) CHILD'S BED

(75) Inventor: Håkan Bergkvist, Bromma (SE)

(73) Assignee: BabyBjörn AB, Solna (SE)

( * ) Notice: Subject to any disclaimer, the term of this patent is extended or adjusted under 35 U.S.C. 154(b) by 588 days.

(21) Appl. No.: 10/590,317

(22) PCT Filed: May 3, 2006

(86) PCT No.: PCT/SE2006/000534
§ 371 (c)(1),
(2), (4) Date: Aug. 23, 2006

(87) PCT Pub. No.: WO2006/135299
PCT Pub. Date: Dec. 21, 2006

(65) Prior Publication Data

US 2008/0271244 A1 Nov. 6, 2008

(30) Foreign Application Priority Data

Jun. 14, 2005 (SE) ..... 0501351

(51) Int. Cl.
*A47D 7/00* (2006.01)

(52) U.S. Cl. ..... 5/99.1; 5/93.1

(58) Field of Classification Search ..... 5/93.1, 5/98.1, 99.1, 312, 110, 111; 403/64, 166, 403/229, 304, 109.1, 109.8; 16/326, 327, 16/329
See application file for complete search history.

(56) References Cited

U.S. PATENT DOCUMENTS 2,646,577 A * 7/1953 Thayer ..... 5/114
2,691,177 A 10/1954 Leonard
3,018,493 A * 1/1962 Wittbrodt ..... 5/99.1
3,789,439 A 2/1974 Berg et al.
4,063,830 A * 12/1977 Ban ..... 403/3
4,811,437 A * 3/1989 Dillner et al. ..... 5/99.1
4,837,875 A 6/1989 Shamie et al.
5,542,151 A * 8/1996 Stranski et al. ..... 16/326
5,581,827 A * 12/1996 Fong et al. ..... 5/98.1
5,697,111 A * 12/1997 Dillner et al. ..... 5/99.1

FOREIGN PATENT DOCUMENTS

DE 481037 * 8/1929
WO WO 92/02161 2/1992

OTHER PUBLICATIONS

"Standard Consumer Safety Specification for Non-Full-Size Baby Cribs/Play Yards." *ASTM International*. (2008): 1-22.

* cited by examiner

*Primary Examiner* — Shane Bomar
*Assistant Examiner* — Gilbert Y Lee
(74) *Attorney, Agent, or Firm* — Jacobson Holman PLLC

(57) ABSTRACT

A bed for a child has a sack of a flexible material, which by a bottom rests on the floor and which has the mouth part thereof connected to a rectangular frame. The frame is formed of two frame parts, which are mutually connected via folding fittings that allow the frame parts to be folded into a parallel and overlapping relation. The frame is provided with one obliquely outward downward sloping leg in each corner. The legs are configured to fold back against the underside of the respective frame part in order to lie within the area of the frame part. The free end of the respective leg is connected to an adjacent bottom corner of the sack in order to facilitate the folding-out and collapsing, respectively, of the bag in connection with the erection and collapse, respectively, of the child's bed.

14 Claims, 3 Drawing Sheets

CHILD'S BED

CROSS-REFERENCE TO RELATED APPLICATION

This is a nationalization of PCT/SE06/000534 filed May 3, 2006 and published in English.

BACKGROUND OF THE INVENTION

1. Field of Invention

The invention relates to a child's bed having a ring-shaped frame and legs connected to the frame, as well as a sack of flexible material mounted on the frame. The sack has the opening verge part thereof connected to the frame. The frame has two mutually turnably mounted frame parts, the nearby branch ends of which are mutually connected to folding fittings, which allow the frame parts to be folded between a first end position substantially in a common plane, and a second end position in which the frame parts are parallel and overlapping. Each leg is foldably connected to an appurtenant attachment of the frame, for foldability between a first end position supporting the frame, and a second end position, in which the legs are folded back substantially parallel to the plane of the frame parts.

2. Description of the Prior Art

A child's bed of a transportable nature has to be dismountable in order to occupy a small space in a dismounted state. Furthermore, the child's bed should have a low weight and be easy to dismount and assemble, respectively. Furthermore, in the erected state, the child's bed should be stable and have a good child safety.

In that connection, the child's bed should comprise a ring-shaped frame that is carried at a distance above a ground by means of dismountable legs and that carries a bed bottom, which is provided with flexible side walls connected to the frame at a considerable distance above the bed bottom, in order to prevent a small child from leaving the bed.

SUMMARY OF THE INVENTION

Therefore, an object of the invention is to further develop a child's bed of the outlined kind, which entirely or partly meets one or more of the above-mentioned desires.

The object of the invention is achieved in that the frame is provided with one leg attachment for each leg, with the leg attachment having a conical shape and a leg end connecting thereto having a corresponding conical complementary surface, and that spring members are provided in order to axially pull together the end of the leg and the leg attachment into connection with each other.

The invention is described in the following written description.

Various embodiments of the invention are as described herein.

BRIEF DESCRIPTION OF THE DRAWINGS

In the following, the invention will be described by way of examples, reference being made to the appended drawings.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
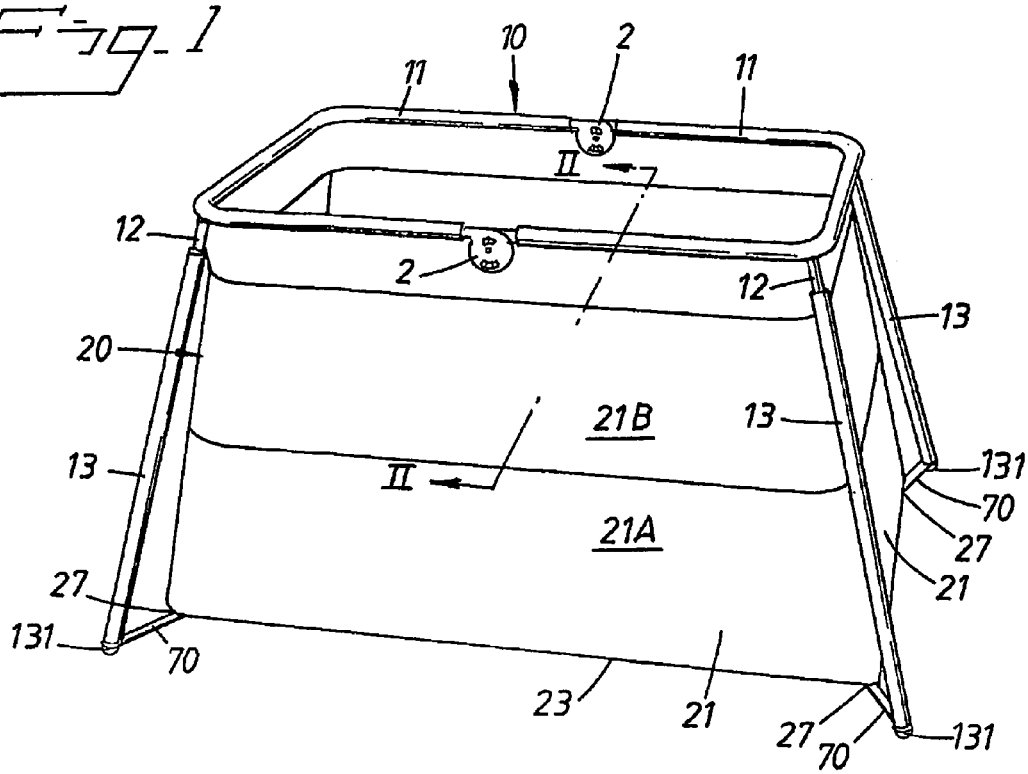
FIG. 1 schematically and perspectively shows a child's bed.

FIG. 1 illustrates a rectangular planar frame 10, which comprises two mutually equal, generally U-shaped frame parts 11, which connect to each other via folding fittings 2, which allow the frame parts 11 to be folded into an overlapping parallel state. At each corner of the frame 10, there is a leg attachment 12 and a leg 13 detachably mounted thereto, which from a planar ground (the floor) carries the frame 10 parallel to the ground in relation to a vertical plane that extends through the frame corners, and the legs 13 are sloped obliquely downward at an angle of approx. 15° in relation to a vertical through the attachment 12.

The frame 10 carries a bed structure of a flexible material shaped in the form of a sack 20. The sack has a bottom 23, which rests on the floor/the ground, and side walls 21, which extend up to the frame 10 and are connected to the same. The walls 21 usually comprise a lower part 21A of opaque fabric and an upper part 21B of a transparent material, for instance a net material. The upper verge part of the sack 20 is folded over from the inside outwards, the folded-over verge part being connected to the upper part of the wall 21 by fastening members, for instance zippers 24 along the respective side of the frame 10. The folded-over portion of the sack also extends around the corners of the frame, while the fastening elements 24 do not extend around the frame corners.

Figure 3:
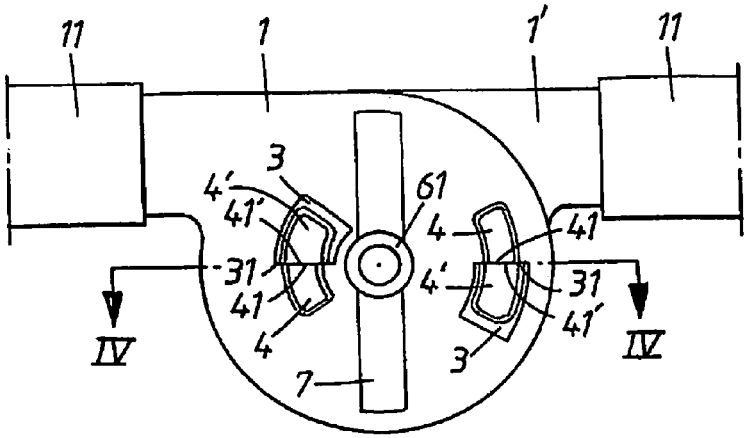
FIG. 3 shows a side view of a folding fitting of the bed frame.
Figure 4:
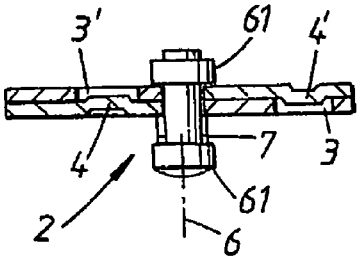
FIG. 4 schematically illustrates a section taken along the line IV-IV in FIG. 3.

In a preferred embodiment, the fitting 2 may comprise two mutually equal, flat sheet-metal elements 1, which are shown to be composed of a circular main part having a shank projecting tangentially therefrom, which is fixed to the end of the respective frame part 11. The two mutually equal sheet-metal parts 1, 1' abut each other planarly and are mutually coupled to a pivot axis 6, which is shown to have a head 61 at each end. A spring 7 on each side of the fitting is kept in contact with the two elements 1, 1' to normally hold the same in surface abutment against each other. In order to hold the branch ends of the frame parts 11, in the state according to FIG. 1, axially directed against each other and prevent the points of connection of the frame parts from being lowered downward in FIG. 1, each element 1, 1' is shown to have an opening 3, 3' and a countersink 4, 4' connecting in the circumferential direction of the opening. The countersunk portions 4, 4' of the two elements 1, 1' will meet end-to-end in the adjacent opening edges 31, 31' of the openings 4, 4'. By the fact that the countersunk/deformed portions 4, 4' are rounded at the opposite opening edges, the countersunk portions 4, 4' can slide out of the respective opening when the fitting 2 is folded in such a direction that the fittings 2 are lifted upward in relation to the state according to FIG. 1. In doing so, the elements 1' separate in the direction of the axis 6 against the action of the spring elements 7. In FIG. 3, two locking devices are shown established in diametrically opposed areas of the pair of elements 1'.

The leg 13 should be arranged foldable in relation to the frame 11, from a stably folded-out state, to a lowered position near the plane of the respective frame part 11. In this connection, the leg 13 may be connected to the frame 11 by a hinge device having a pivot axis and having hinge portions connected to each other. By the fact that the legs 13 converge toward each other in the direction upward to a point above the central part of the frame, no blocking of the legs 13 is required in the erected state of the bed, but a blocking is yet preferable, for reasons of safety.

Figure 5:
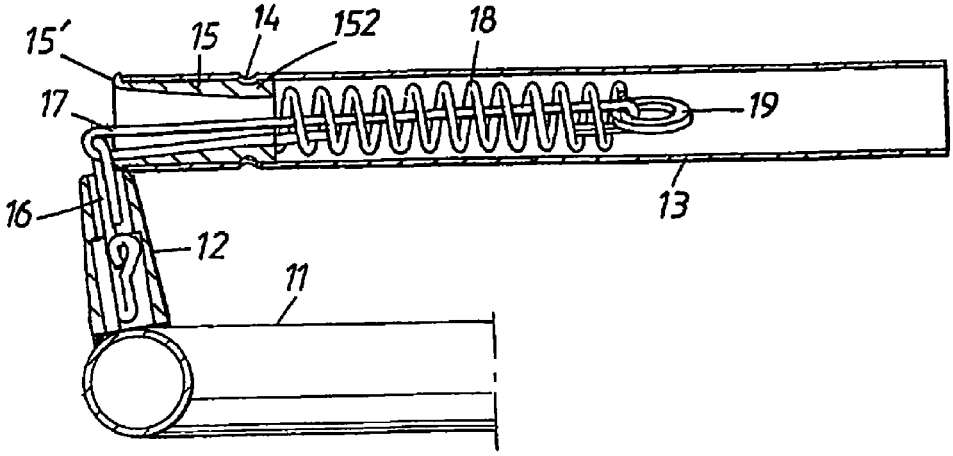
FIG. 5 schematically illustrates a support leg and the connection thereof to the frame, in axial section.
Figure 6:
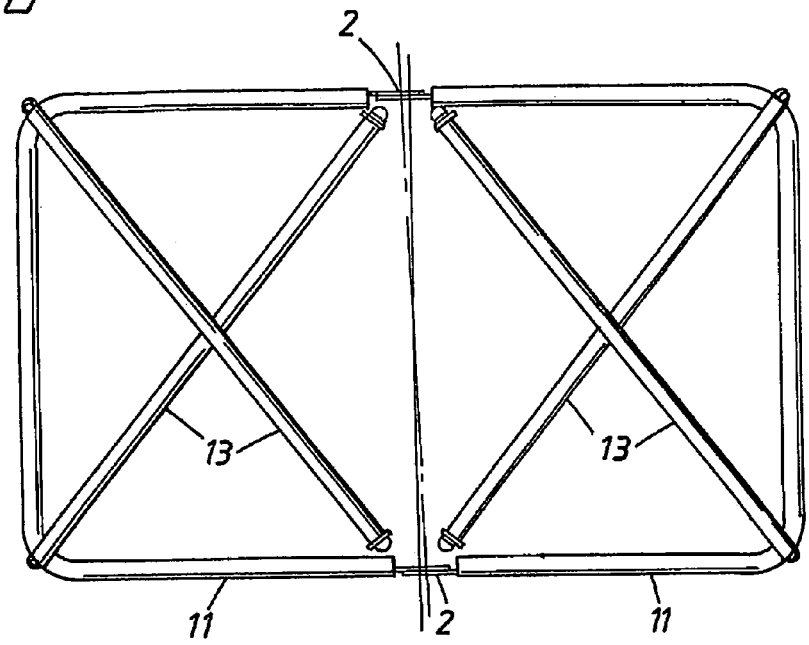
FIG. 6 schematically shows a planar view of the frame with the legs lowered in the plane of the frame.

FIG. 5 illustrates a connection between a leg 13 and an attachment 12 of the frame part 11 associated thereto. It can be seen that the attachment 12 is in the form of a metallic sleeve conically tapering toward the free outer end thereof, and that the end part of the leg 13 mating therewith receives a corresponding conical sleeve 15, which with an end flange 15' rests against the end of the leg. The sleeve 15 has also an opposite end flange, which rests around the inner circumference of the leg 13. The sleeve has a recess in the outer circumference thereof, and is fixed in the tube end by means of an indentation 14 in the tube wall, the indentation 14 engaging in the external recess of the sleeve. In FIG. 5, it is seen that a drawbar 16 is anchored in the frame element 11 or the attachment 12 and extends through the attachment 12 and has a bent over portion outside the free end of the attachment 12. In the bent-over end of the draw element 17, a bent-over hook part or loop of a drawbar 16 engages, which extends into the leg 13 and is surrounded by a screw compression spring 18. The opposite end of the draw element 17 is bent over and extends through an opening in a circular washer 19, the diameter of which is somewhat smaller than the inner diameter of the leg 13, and thereby offers a support to the inner end of the spring 18. The outer end of the spring 18 rests against the inner end flange 152 of the sleeve 15. In the shown state according to FIG. 5, the spring 18 is compressed and aims to pull together the leg 13 and the attachment 12. Already upon a small folding-out of the leg 13 (upward in FIG. 5), the spring 18 aims to pull down the end of the leg with the sleeve 15 onto the conical tubular attachment 12 into a mutual stable engagement. Thanks to the conicity, a long and stable axial engagement length is presented between the sleeve and the attachment 12 and the coupling may furthermore simply be released by axial separation.

Figure 2:
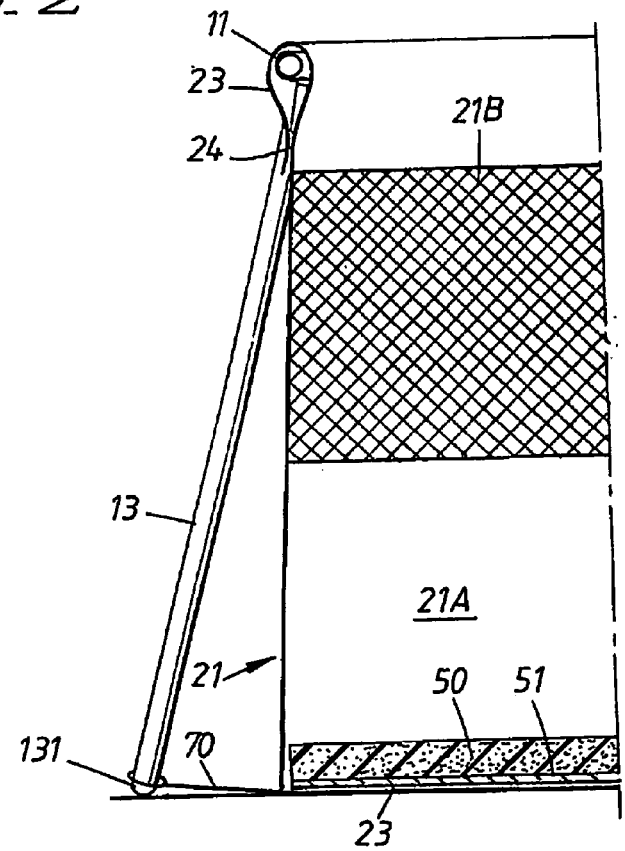
FIG. 2 schematically illustrates a section taken along the line II-II in FIG. 1.

From FIGS. 1 and 2, it can be understood that the free end part 131 of the leg 13 is connected to the respective adjacent bottom corner 27 of the sack by a connecting element 70, for instance in the form of a flexible band.

In FIG. 2 is also shown that a rigid plate 51 is laid on top on the bottom 23 of the sack 20 and that a mattress 50, for instance a foam-plastic plate, is laid on top of the rigid plate 51.

Figure 7:
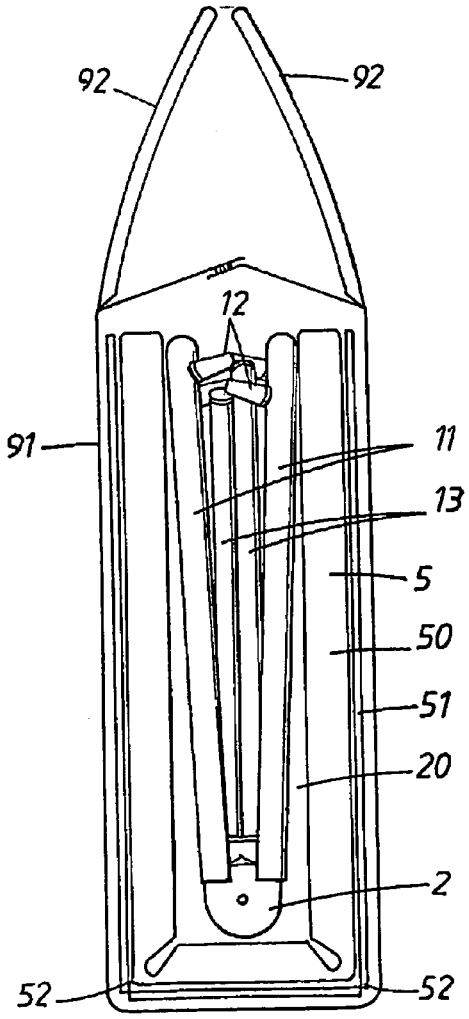
FIG. 7 illustrates the bed according to FIG. 1 in the collapsed state and inserted in a parallelepipedic bag having carrying handles.

The bed according to FIG. 1 can readily be collapsed by taking the mattress 50 and the plate 51 out of the sack 20. The plate 51 has two parallel, spaced-apart scoring lines 52 in the longitudinally central area of the plate 51. The bed according to FIG. 1 is then placed upside down on the ground, after which the legs 13 are folded back over the respective frame part 11, after which the frame parts 11 are folded back towards each other by turning in the fittings 2. Next, the collapsed frame with the sack 20 is placed in the doubled mattress 50 and furthermore the plate 51 is placed in a doubled state outside the mattress 50 as is seen in FIG. 7, after which the parallelepipedic bed package thus put together is placed in a parallelepipedic bag 91 mating therewith, which is shown to have carrying handles 92. Naturally, the bag 91 may also have a cover including a zipper closure.

In order to erect the bed to the state according to FIG. 1 from the collapsed state corresponding to FIG. 7, the collapsed frame 10 is taken out, and is oriented with the flame parts 11 vertical and with the fittings 2 upward, after which the operator seizes each of the short ends of the frame and turns apart the frame parts 11. In doing so, the legs 13 will automatically, under the impact of the spring 18, be folded-out into alignment against the attachments 12 and stably engage the same. Since the upper verge of the sack is attached to the frame 10 and furthermore the bottom corners 27 of the sack are attached to the free ends of the legs 13 by the verge 70, the child's bed immediately and automatically assumes the state shown in FIG. 1 and can be put down on the floor. After putting in the mattress 50 and possibly the plate 51, the bed is ready to be used.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A bed for a child, comprising:

a ring-shaped frame;

legs connected to the frame;

a sack of flexible material mounted on the frame with an opening verge part of the sack connected to the frame, a bottom of the sack being configured to (i) rest on a floor on which the legs of the bed, once erected, rest, and (ii) extend over an area that substantially corresponds to an area surrounded by the frame;

a mattress having a bottom area corresponding to the bottom of the sack; and a rigid integral bottom plate located between the mattress and the bottom of the sack, the bottom plate being rigid in two directions and having only two parallel spaced-apart scoring lines which are positioned in a longitudinally central area of the bottom plate and which extend perpendicularly to a longitudinal direction of the bottom plate, so as to provide two rigid end sections connected to each other via the two scoring lines separated by a rigid middle section, the rigid middle section having a smaller width in the longitudinal direction of the bottom plate than the two end sections, the bottom plate being foldable into a substantially U-shaped configuration that houses therein the mattress and the frame, the frame including two mutually turnably mounted frame parts with adjacent branch ends of the frame parts being mutually connected to folding fittings which allow the frame parts to be folded between a first end position substantially in a common plane, and a second end position in which the frame parts are parallel and overlapping, and each leg being foldably connected to a leg attachment of the frame, for foldability between a first end position supporting the frame, and a second end position, in which the legs are folded back substantially parallel to the plane of the frame parts, the frame being provided with one leg attachment for each leg, the leg attachment having a conical shape and a leg end connecting thereto having a corresponding conical complementary surface for releasable attachment to each other, and spring members being provided in order to axially pull together the end of the leg and the leg attachment into connection with each other.

2. The bed according to claim 1, wherein the legs when being operatively connected to the frame converge toward a common point that is centrally positioned above the central part of the frame, the legs sloping at an angle of from 5-25° to vertical.

3. The bed according to claim 2, wherein the legs slope at an angle of approximately 15° to the vertical.

4. The bed according to claim 1, wherein the spring members are arranged to axially bias the leg against the attachment, and the attachment and the leg are axially united by a central flexible element coupled to the spring member.

5. The bed according to claim 1, further comprising a conical sleeve fixed in the end of the tubular leg, the sleeve having on an outer circumference thereof a recess, and wherein the wall of the tubular leg is deformed for engagement in the recess of the sleeve for axial locking of the sleeve in the leg.

6. The bed according to claim 1, wherein the folding fittings of the frame are arranged to allow the frame parts to be folded against each other into a direction in which the leg attachment of the frame parts are facing each other.

7. The bed according to claim 1, wherein the free ends of the legs are connected to an adjacent portion of the sack near the bottom wall of the sack.

8. The bed according to claim 1, wherein the frame is rectangular and the support leg is connected to the respective corner area of the frame.

9. The bed according to claim 1, wherein spring loading that is exerted by the spring member between the leg and the leg attachment is chosen to produce an automatic stable connection of the leg and the leg attachment when a direction of the leg approaches a direction of the attachment.

10. The bed according to claim 1, wherein the opening verge portion of the sack is folded over and around the frame against the outside of the sack and is correspondingly attached along the respective frame piece, the corner area of the frame, and wherein the joint along the respective frame side consists of a zipper.

11. The bed according to claim 1, wherein the folding fitting includes two mutually equal hinge elements, which are turnably arranged around a common central pivot axis normal to a plane of the hinge elements, the hinge elements are axially spring-loaded into parallel and surface-extended abutment against each other and the hinge elements have an opening each arranged at a distance from the axis and extending in a circumferential direction, and a protrusion from a plane thereof, adjacent to the opening, following in a direction of circumference, the two ends of the protrusion, which connect to the hinge-element opening, abutting against each other in the end position of the fitting, in which the frame parts are folded-out in a common plane.

12. A bed for a child, comprising:

a ring-shaped frame;

a plurality of legs connected to the frame;

a sack of flexible material mounted on the frame with an opening verge part of the sack connected to the frame, a bottom of the sack being configured to (i) rest on a floor on which the legs of the bed, once erected, rest, and (ii) extend over an area that substantially corresponds to an area surrounded by the frame;

a mattress having a bottom area corresponding to the bottom of the sack; and a rigid integral bottom plate located between the mattress and the bottom of the sack, the bottom plate being rigid in two directions and having only two parallel spaced-apart scoring lines which are positioned in a longitudinally central area of the bottom plate and which extend perpendicularly to a longitudinal direction of the bottom plate, so as to provide two rigid end sections connected to each other via the two scoring lines separated by a rigid middle section, the rigid middle section having a smaller width in the longitudinal direction of the bottom plate than the two end sections, the bottom plate being foldable into a substantially U-shaped configuration that houses therein the mattress and the frame, the frame including two mutually turnably mounted frame parts, with branch ends of the frame parts being mutually connected to folding fittings which enable the frame parts to be folded between a first end position substantially in a common plane, and a second end position in which the frame parts are parallel and overlapping, and each leg being foldably connected to a leg attachment of the frame, for foldability between a first end position supporting the frame, and a second end position, in which the legs are folded back substantially parallel to the plane of the frame parts, the frame having one of the leg attachments for each of the legs, the leg attachment having a conical shape and a leg end connecting thereto having a corresponding conical complementary surface for releasable attachment to each other, with spring members being provided to axially pull the end of the leg and the leg attachment into connection with each other, and the folding fittings of the frame being configured to allow the frame parts to be folded against each other into a direction in which the leg attachment of the frame parts are facing each other.

13. The bed according to claim 12, wherein each of the legs when operatively connected to the frame converges toward a common point that is centrally positioned above a central part of the frame, the leg sloping at an angle of from 5 to 25° relative to a vertical plane.

14. The bed according to claim 12, wherein the spring members are configured to axially bias the leg against the leg attachment, and the leg attachment and the leg are axially connected by a central flexible element coupled to the spring member.

* * * * *